United States Patent [19]

Baker et al.

[11] Patent Number: 5,052,413

[45] Date of Patent: Oct. 1, 1991

[54] METHOD FOR MAKING A SMOKING ARTICLE AND COMPONENTS FOR USE THEREIN

[75] Inventors: Max N. Baker, Rural Hall, N.C.; Vernon B. Barnes, Clemmons, N.C.; Douglas C. Clark, Winston-Salem, N.C.; Jack F. Clearman, Blakely, Ga.; Gerhard Hensgen, Hamburg, Fed. Rep. of Germany; Michael D. Shannon, Lewisville, N.C.; Gary R. Shelar, Greensboro, N.C.; Alfred Schubert, Wentorf, Fed. Rep. of Germany

[73] Assignee: R. J. Reynolds Tobacco Company, Winston-Salem, N.C.

[21] Appl. No.: 104,202

[22] Filed: Oct. 2, 1987

Related U.S. Application Data

[63] Continuation-in-part of Ser. No. 19,826, Feb. 27, 1987, abandoned.

[51] Int. Cl.[5] ..... A24C 5/14; A24C 5/18; A24C 5/28; A24D 1/02

[52] U.S. Cl. ..... 131/77; 131/78; 131/80; 131/81.1; 131/83.1; 131/84.1; 131/94; 131/335; 131/194

[58] Field of Search ..... 131/70-76, 131/94, 77, 78, 80, 84.1, 280, 194, 335, 83.1

[56] References Cited

U.S. PATENT DOCUMENTS

| | | | |
|---|---|---|---|
| Re. 25,917 | 11/1965 | Stelzer . | |
| 1,559,322 | 10/1925 | Hohn . | |
| 2,035,211 | 3/1936 | Aivaz | 131/72 |
| 2,349,551 | 10/1943 | Helm . | |
| 2,427,957 | 9/1947 | Getts Jr. | 131/71 |
| 3,036,581 | 5/1962 | Dearsley . | |
| 3,096,772 | 7/1963 | Korber . | |
| 3,199,418 | 8/1965 | Schubert . | |
| 3,199,515 | 8/1965 | Lowe . | |
| 3,362,413 | 1/1968 | Redford . | |
| 3,368,460 | 2/1968 | Schubert . | |
| 3,397,700 | 8/1968 | Harlow et al. | 131/335 |
| 3,513,856 | 5/1970 | Sexstone . | |
| 3,614,956 | 10/1971 | Thornton . | |
| 3,736,941 | 6/1973 | Molins et al. . | |
| 3,840,028 | 10/1974 | Yatrides . | |
| 3,957,062 | 5/1976 | Labbe et al. . | |
| 3,987,804 | 10/1976 | Molins et al. . | |
| 4,200,179 | 4/1980 | Hinz . | |
| 4,207,720 | 6/1980 | Tolasch et al. . | |
| 4,237,778 | 12/1980 | Hausler et al. . | |
| 4,238,994 | 12/1980 | Koch . | |
| 4,340,072 | 7/1982 | Bolt et al. . | |
| 4,487,001 | 12/1984 | Tolasch et al. . | |
| 4,489,534 | 12/1984 | Gomann et al. . | |
| 4,714,082 | 12/1987 | Banerjee et al. . | |

FOREIGN PATENT DOCUMENTS

| | | | |
|---|---|---|---|
| 0174645 | 3/1986 | European Pat. Off. . | |
| 0212234 | 3/1987 | European Pat. Off. . | |
| 0236992 | 9/1987 | European Pat. Off. . | |
| 2715994 | 10/1986 | Fed. Rep. of Germany . | |
| 102229 | 9/1987 | Fed. Rep. of Germany . | |
| 0110460 | 1/1961 | Pakistan | 131/94 |
| 1107181 | 3/1968 | United Kingdom . | |

OTHER PUBLICATIONS

Hauni-Werke Korber & Co. KG. Hamburg, Germany, Brochure No. 1 Re: Cigarette Manufacture, 1983 Edition.

Hauni-Werke Korber & Co. KG, Hamburg, Germany, Brochure No. 2, Re: Filter Rod Production, 1983 Edition.

Hauni-Werke Korber & Co. KG, Hamburg, Germany, Brochure No. 3, Re: Transfer Systems, 1983 Edition.

*Primary Examiner*—V. Millin

*Attorney, Agent, or Firm*—Grover M. Myers; David G. Conlin

[57] ABSTRACT

A method for making a smoking article is described wherein an aerosol generating cartridge is inserted into a sleeve, preferably having a tobacco insulating material.

Also described are articles of manufacture having an elongate jacket module with a rod segment and an annular segment. The rod segment has a length of rod of fibrous material. Disposed logitudinally on either side of the rod segment is an annular segment of insulating material.

Additionally, articles of manufacture useful for making smoking articles are described having an elongate structure with two or more repeating sections wherein each section preferably has a tobacco-containing spacer segment and mouthend segment.

79 Claims, 9 Drawing Sheets

METHOD FOR MAKING A SMOKING ARTICLE AND COMPONENTS FOR USE THEREIN

BACKGROUND OF THE INVENTION

This is a continuation-in-part of copending U.S. application Ser. No. 019,826, now abandoned, filed Feb. 27, 1987, the disclosure of which is hereby incorporated by reference.

In commonly owned copending applications Ser. No. 790,484, filed Oct. 23, 1985 now Pat. No. 4,714,082, and Ser. No. 791,721, filed Oct. 28, 1985, now Pat. No. 4,756,318, and in European Patent Publications 0174645(A2) and 0212234(A2), there are disclosed a number of alternative forms of smoking articles which typically embody (1) an aerosol generating cartridge comprising a fuel element for generating heat for transfer to an aerosol forming material which may contain a tobacco flavoring material, (2) a sleeve or jacket circumscribing the cartridge, the sleeve preferably including an insulating material around the fuel element and a tobacco containing material around the aerosol forming material, and optionally (3) a mouthend piece, which may contain a filter element. It is a purpose of this invention to provide a method of fabricating and combining such components in an appropriate fashion suitable for large scale production.

SUMMARY OF THE INVENTION

In accord with the present invention, various methods for making smoking articles are provided. The methods generally comprise making an aerosol generating module by providing an aerosol generating cartridge having a fuel element and an aerosol forming material, providing a sleeve or jacket segment for receiving the aerosol generating cartridge, and inserting the aerosol generating cartridge into the sleeve to form the aerosol generating module. Preferably, the sleeve or jacket segment contains a section of insulating material and a section containing tobacco. The aerosol generating module can be used as a disposable element with a holder such as a cigarette holder. The module can also be combined as a unit with a mouthend module that may contain a filter type element.

The invention also provides components and methods for making components useful for making such smoking articles. Thus, in one embodiment, a method for making one component, such as a sleeve or a jacket module useful for making a sleeve, comprises assembling in axial alignment an alternating series of rods of material and annular members of insulating material, wrapping the rods and annular members in a common wrapper to form an integrated structure of alternating rods and annular members, and cutting the integrated structure to form jacket modules, each module comprising a length of rod, at each end of which is an annular member or sleeve. As used herein, the term "rod" means a cylindrically shaped length of material such as a tobacco rod in a conventional cigarette.

The invention further provides a method for making aerosol generating modules. In one embodiment, this method involves providing jacket modules and aerosol generating cartridges as described above, cutting the jacket modules to form jacket segments that comprise a rod joined to a sleeve, making a hole in the rod section of the jacket segments, and inserting the aerosol generating cartridges into the jacket segments such that the fuel element is disposed within the annular member or sleeve portion and the aerosol generating cartridge is disposed within the hole in the rod.

Preferably the annular member of the jacket module is made by forming an annular sleeve around a removable support or a sleeve forming member, and then removing the sleeve forming member to permit the sleeve to be disposed around the fuel element.

In one preferred embodiment of the invention, the rod section of the jacket segment comprises a rod of tobacco, and the hole is formed by a passage forming member which is preferably removed while the aerosol generating cartridge is inserted into the jacket segment. In preferred embodiments wherein the annular member is formed around a sleeve forming member, the sleeve forming member is removed or ejected from the annular member, after the hole is formed in the rod, preferably while the aerosol generating cartridge is inserted into the jacket segment. Most preferably, the removal of the sleeve forming member is accomplished by passage through the hole in the tobacco rod while the aerosol generating cartridge is inserted into the jacket segment.

In certain preferred embodiments of the invention, smoking articles are made by aligning mouthend subassemblies between two aerosol generating modules such that the fuel element ends are positioned outward away from the mouthend subassembly, joining the subassembly and two modules by wrapping them together in a common wrap, and cutting the joined structure to form smoking articles.

Preferably, the method for making the mouthend subassemblies comprises assembling an alternating series of spacer members of suitable material with a plurality of mouthend elements, wrapping the alternating series to form an integrated structure wherein the spacer members alternate with the mouthend elements, and cutting the integrated structure to form mouthend subassemblies having a mouthend element section in the center with a spacer member section at each end.

In other preferred embodiments, the method of making smoking articles according to this invention comprises forming insulating fibers about a support member such as a tube to form a sleeve or annular member of insulating fibers, wrapping the sleeve of insulating fibers with paper, forming tobacco into a rod within a wrapper to have a diameter corresponding to the outside diameter of the sleeve of insulating fibers, aligning a segment of the sleeve of insulating fibers in abutting engagement with an end of the wrapped rod of tobacco, commonly wrapping the sleeve of insulating fibers and the rod of tobacco with a wrapper to join them end-to-end, piercing the tobacco rod to form a hole or opening therein corresponding to the opening in the sleeve of insulating fibers, and inserting an aerosol-generating cartridge through the sleeve of insulating fibers and the opening in the tobacco rod while expelling the tube from the sleeve of insulating fibers, thereby disposing the fuel element and the aerosol generating means in the sleeve of insulating fibers and the rod of tobacco.

DETAILED DESCRIPTION OF THE PREFERRED EMBODIMENTS

The preferred embodiments of the invention will now be described in greater detail with reference to the accompanying drawings, wherein.

Figure 2:
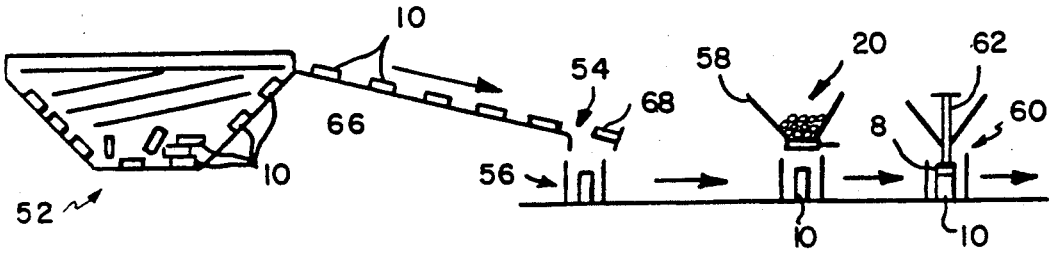
Figure 3:
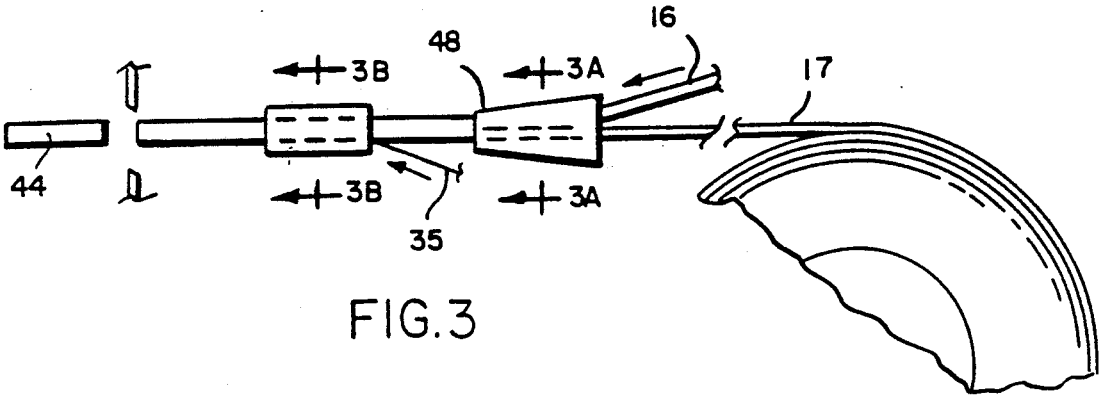
Figure 3A:
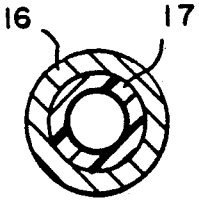
Figure 3B:
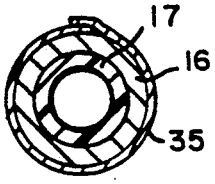
Figure 4A:
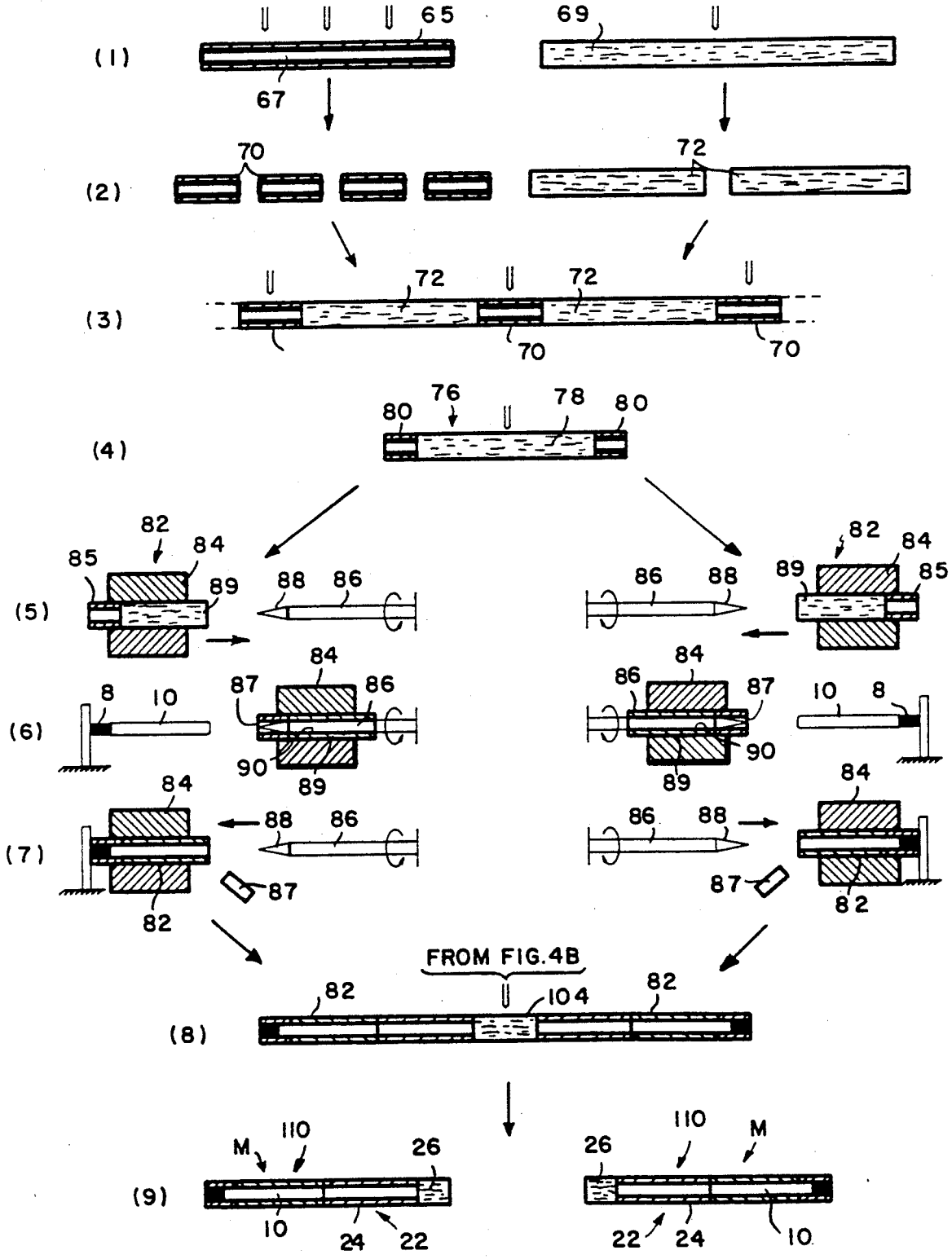
Figure 4B:
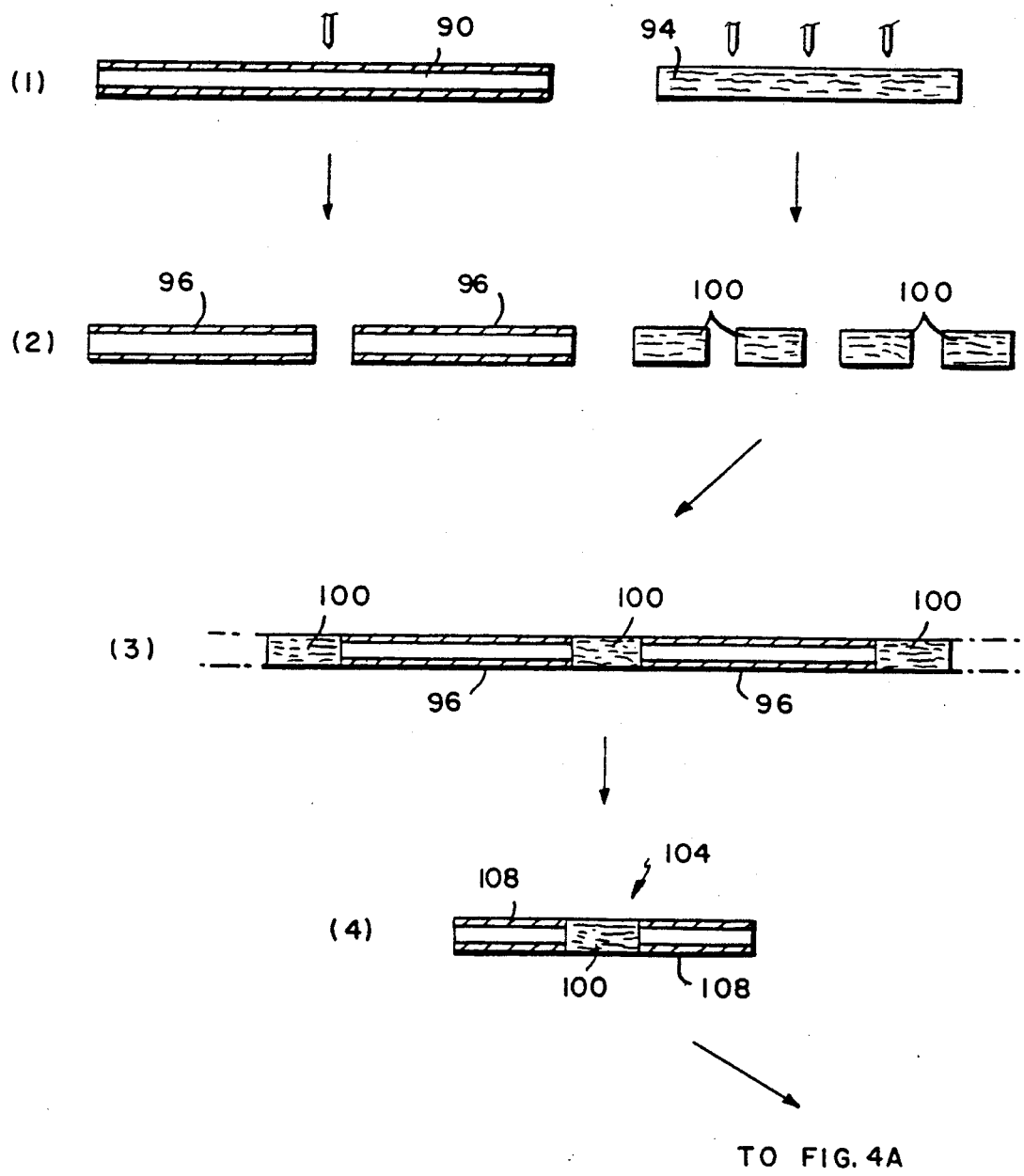
Figure 5:
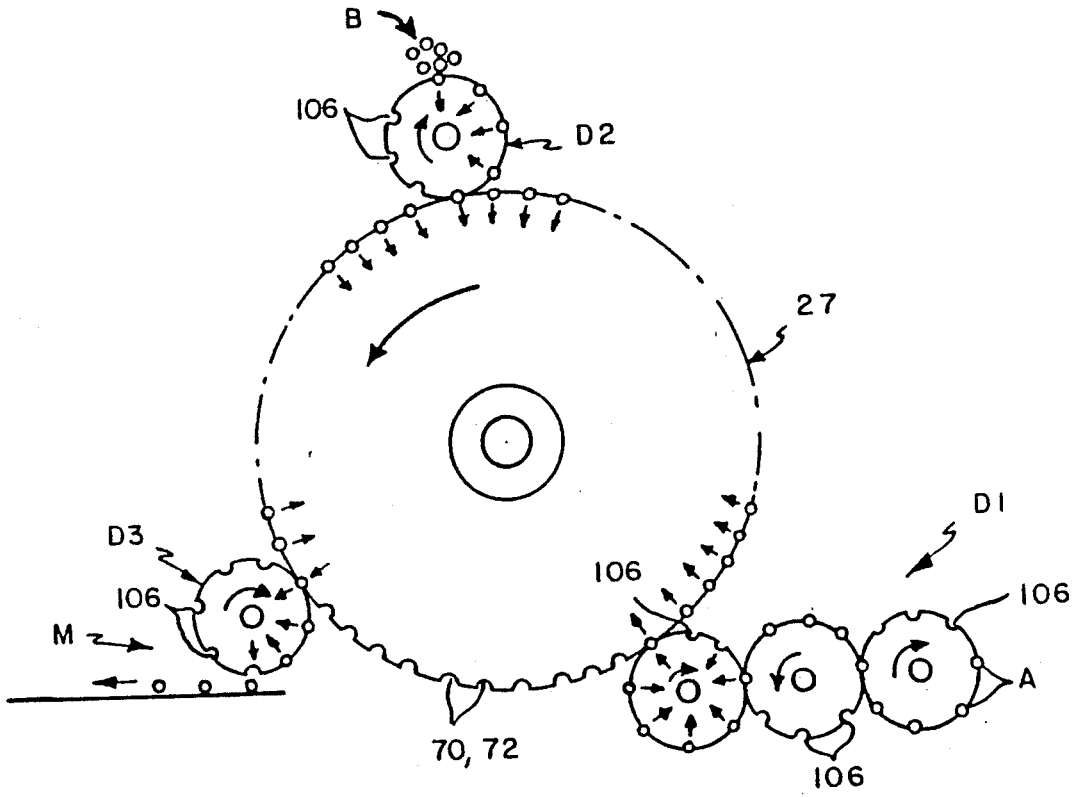
Figure 6A:
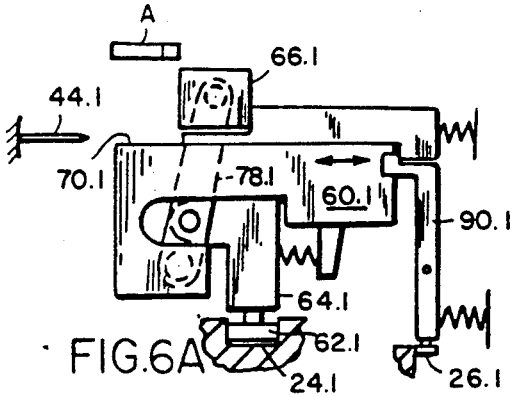
Figure 6E:
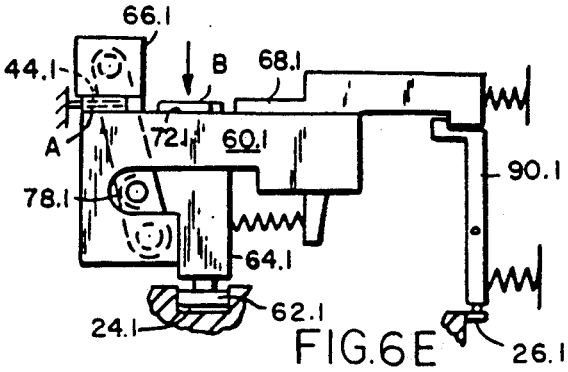
Figure 6B:
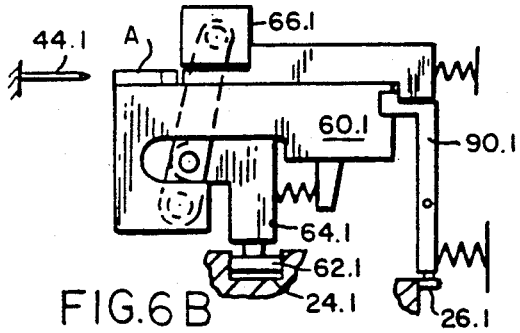
Figure 6F:
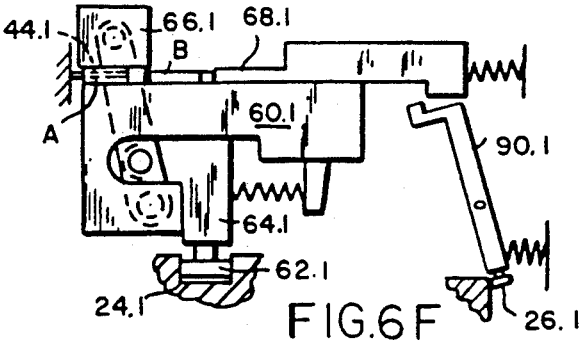
Figure 6C:
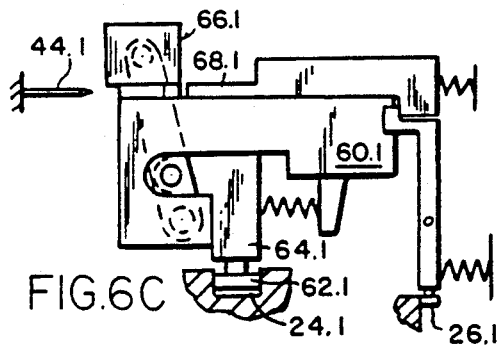
Figure 6G:
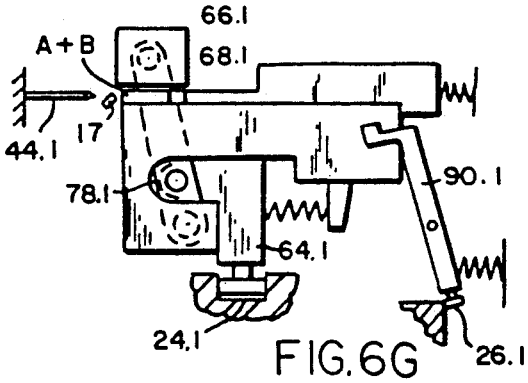
Figure 6D:
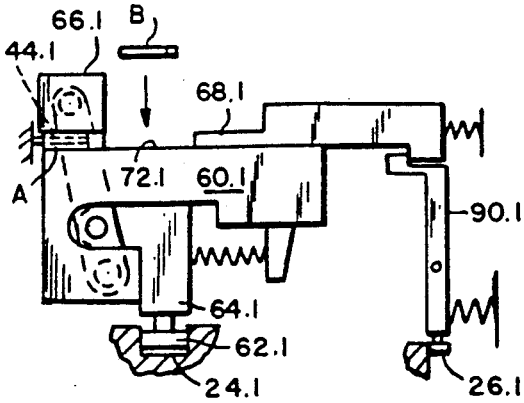
Figure 6H:
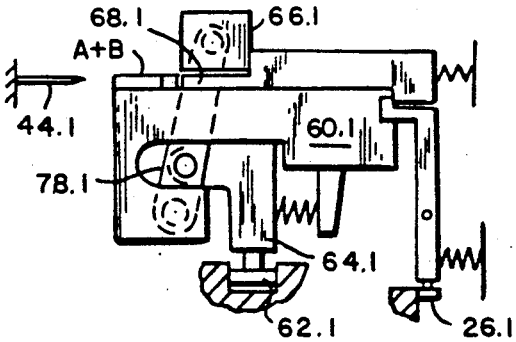
Figure 7A:
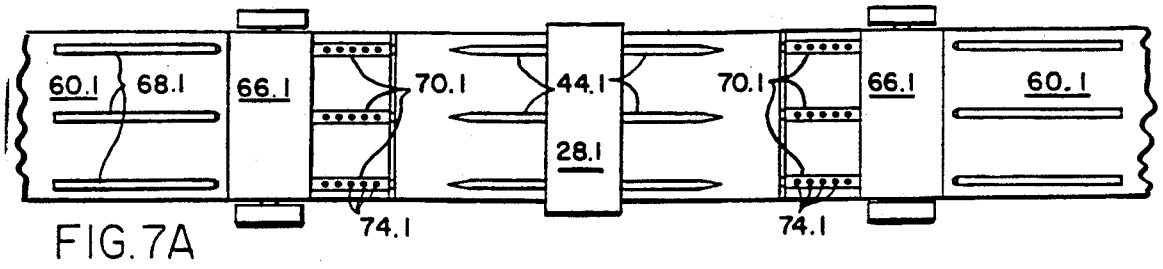
Figure 7B:
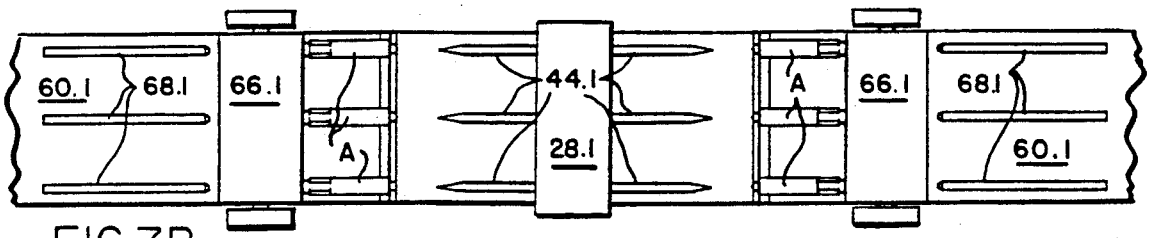
Figure 7C:
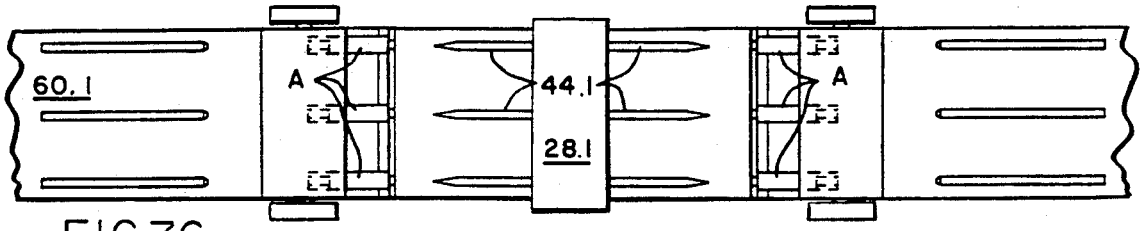
Figure 7D:
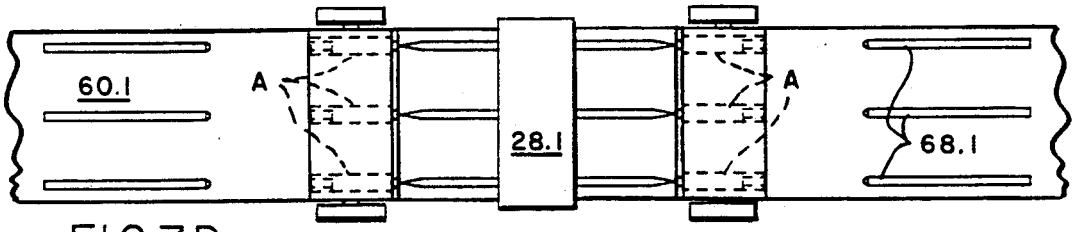
Figure 7E:
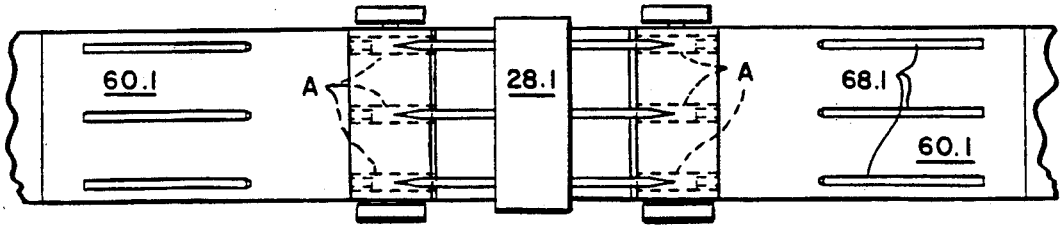
Figure 7K:
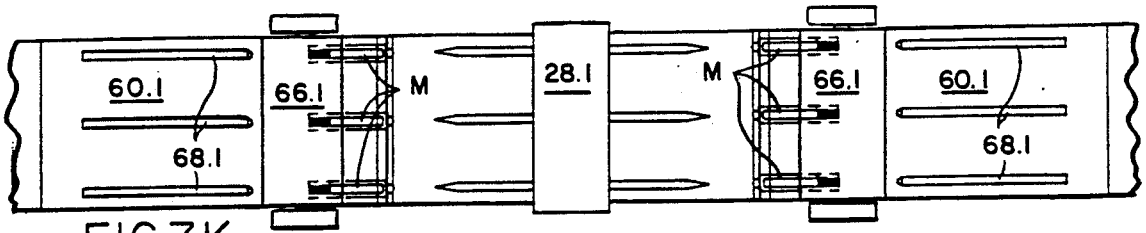
Figure 7L:
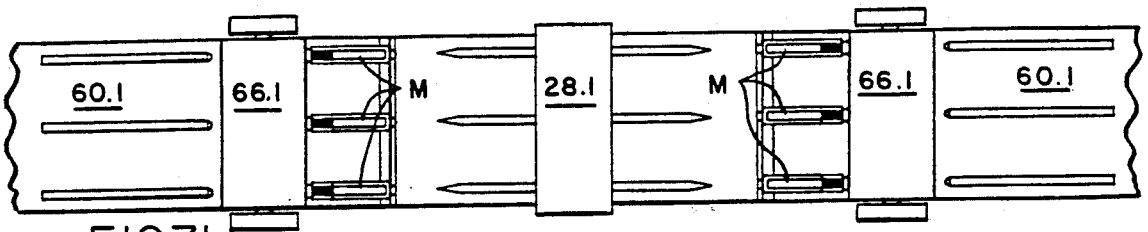
Figure 7M:
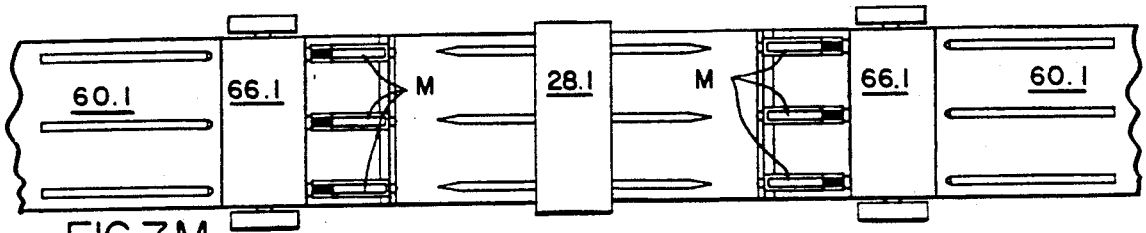
Figure 7N:
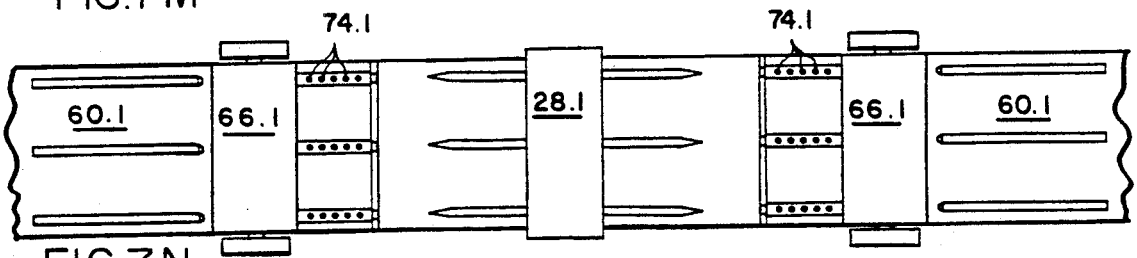
Figure 7O:
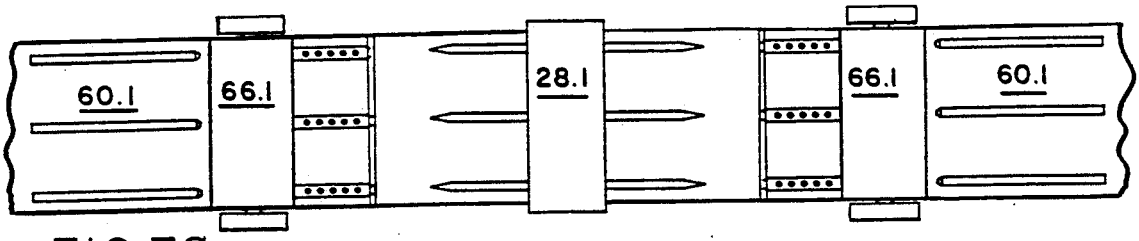
Figure 7F:
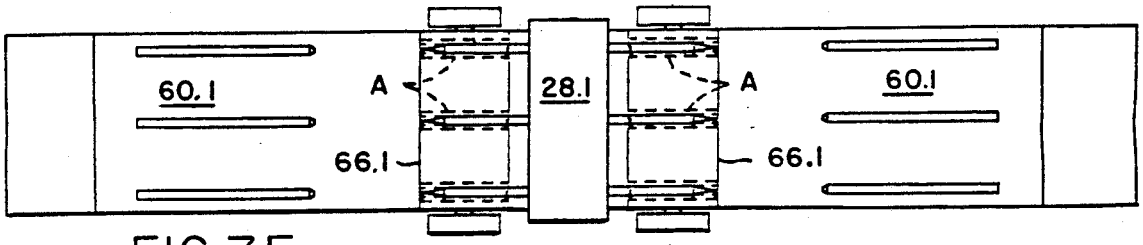
Figure 7G:
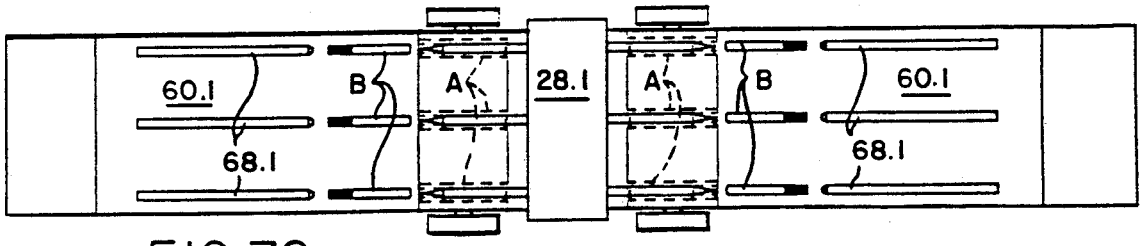
Figure 7H:
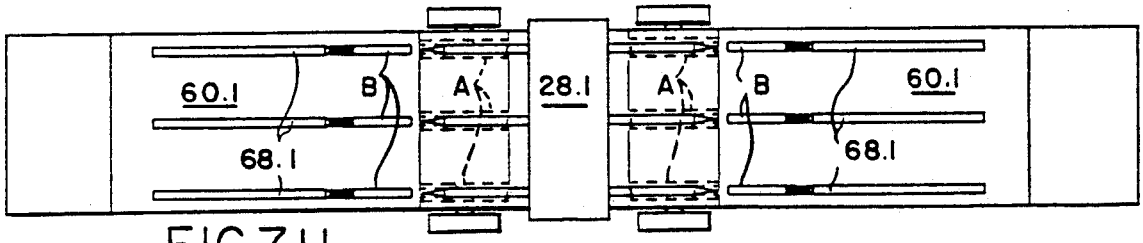
Figure 7I:
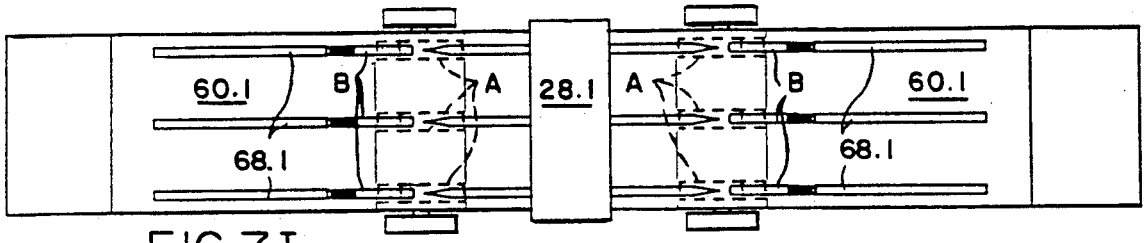
Figure 7J:
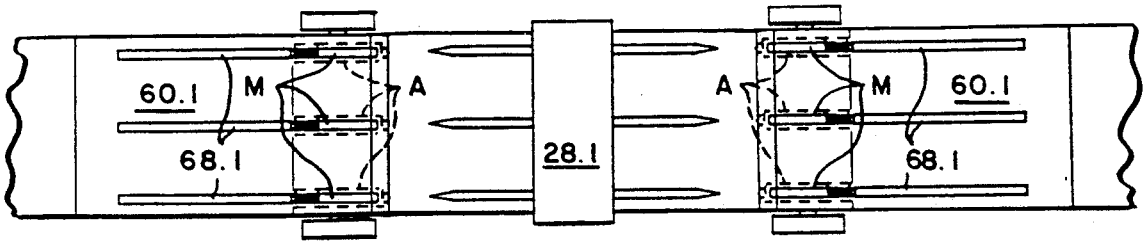

FIG. ID is a diametrical section showing the aerosol generating module, M;

FIG. 2 diagrammatically illustrates one method of providing an aerosol generating cartridge by loading particulate aerosol forming material into a container and inserting a fuel element therein;

FIG. 3 diagrammatically illustrates one method of making an insulating sleeve or jacket for the combustible fuel element;

FIG. 3A is a cross section taken on the line 3A—3A of FIG. 3;

FIG. 3B is a cross section taken on the line 3B—3B of FIG. 3;

FIG. 4A diagrammatically illustrates the structuring of the components which comprise the smoking article made in accord with one embodiment of this invention;

FIG. 4B diagrammatically illustrates the structuring of the mouthpiece end of one embodiment of smoking article made in accord with this invention;

FIG. 5 diagrammatically illustrates a preferred embodiment of an apparatus for inserting aerosol generating cartridges B into jacket segments A comprising a rotating drum, with rotary transfer drums D1 and D2 for depositing components A and B thereon and rotary transfer drum D3 for removing the composite M therefrom;

FIGS. 6A to 6H are partial elevational views that schematically illustrate apparatus for carrying out the successive steps of incorporating the aerosol generating cartridge into the jacket segment consisting of a sleeve of insulating fibers and a rod of tobacco; and FIGS. 7-A to 7-O are partial plan views schematically illustrating successive operations of the apparatus illustrated in FIGS. 6A to 6H for inserting the cartridge into the jacket segment.

Smoking articles made in accordance with the method of the present invention generally include an aerosol generating module which comprises an aerosol generating cartridge and an encircling or circumscribing jacket or sleeve of insulating material and/or tobacco containing material. Preferably, this module is joined to a mouthend module which typically includes a filter-like mouthend element.

One such preferred embodiment of a smoking article made in accordance with the present invention is shown in FIGS. 1 and 1A to 1D. As illustrated, this smoking article includes an aerosol generating module M and a mouthend piece 22. The aerosol generating module M includes an aerosol generating cartridge B, a jacket segment A comprising a circumscribing jacket or sleeve of insulating material 16 and tobacco 15, and circumscribing wrappers 31, 33 and 35. The cartridge B includes a fuel element 8 and a capsule or container 10 which encloses a particulate carrier material 20 bearing an aerosol forming material and which is provided with holes 21 for the passage of such material to the user. The mouthend module 22 includes a spacer member 24 and a cylindrical mouthend element 26 circumscribed by paper wrappers 30, 32, and 36. In this preferred embodiment, the aerosol generating module M and mouthend piece 22 are joined to each other by a circumscribing paper wrapper 34.

Figure 1:
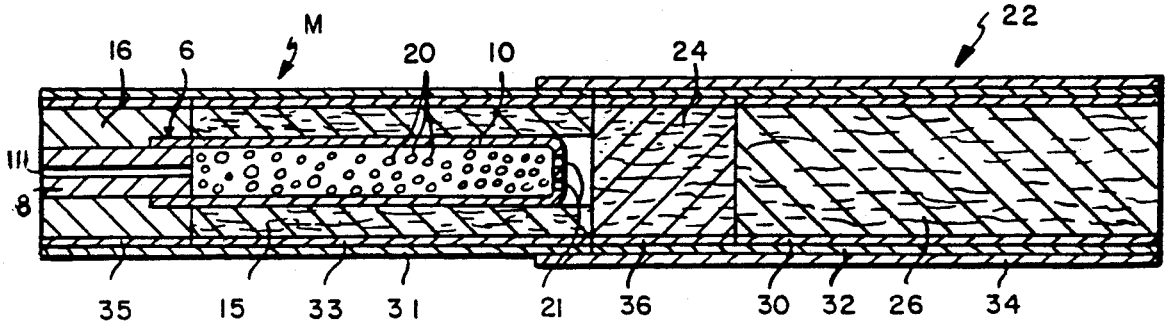
FIG. 1 is a diametrical section of one embodiment of a smoking article made by the method of the instant invention.
Figure 1A:
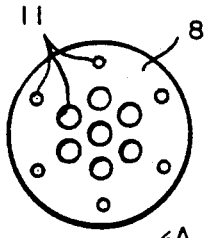
FIG. 1A is a cross section of the fuel element of the article of FIG. 1.
Figure 1B:
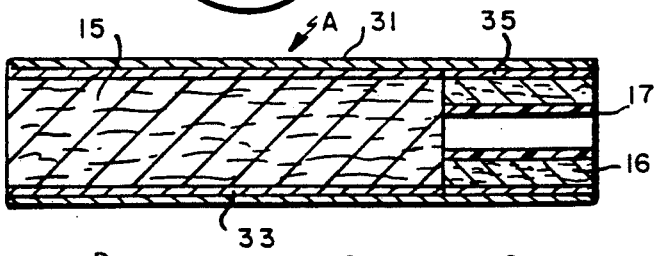
FIG. 1B is a diametrical section of the jacket segment A; prior to the forming of the hole in the rod.

Preferably, the fuel element 8 is a carbonaceous material having a plurality of longitudinal holes 11 shown in FIG. 1A. This fuel element is preferably formed from an extruded mixture of carbon (preferably from carbonized paper), sodium carboxymethyl cellulose (SCMC) binder, $K_2CO_3$, and water. The preferred container or capsule 10 is made of thin walled, preferably deep drawn, aluminum. Two slit-like openings 21 are provided at the mouthend of capsule 10 to permit aerosol to be delivered to the user. The preferred carrier 20 is alumina granules and the preferred aerosol forming material is a mixture of glycerin and tobacco extracts. Preferred insulating materials for the insulating sleeve 16 circumscribing the fuel element 8 are resilient fibrous materials, such as ceramic (e.g., glass) fibers. Preferably the tobacco material 18 which surrounds the portion of container 10 which encloses carrier 20 is conventional cigarette tobacco and/or reconstituted tobacco. The mouthend piece 22 preferably comprises a segment of a folded sheet of tobacco or tobacco containing paper 24 and a segment of folded, meltblown thermoplastic fibers 26 through which the aerosol passes to the user. Spacer member 24 of mouthend piece 22 may also be a tubular member made of cellulose acetate, and the mouthend element 26 may be formed from non-woven polypropylene scrim. The spacer member 24 and mouthend element 26 may abut each other as shown in the drawing, or they may be spaced from one another by a void space or an intermediate member.

Additional details regarding the illustrated smoking article and other smoking articles which may be made in accordance with the present invention are described in European Patent Application Publications Nos. 0174645(A2) and 0212234(A2), and in commonly owned copending applications Ser. Nos. 790,484, filed Oct. 23, 1985 (now U.S. Pat. No. 4,714,082) and 939,592, filed Dec. 9, 1986, all of which are hereby incorporated by reference.

Figure 1C:
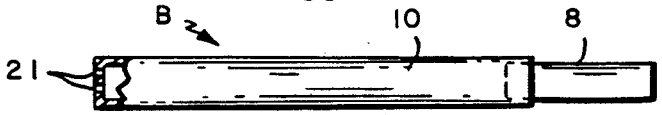
FIG. 1C is an elevation section of the aerosol generating cartridge, B.

A preferred method of assembling the components of the aerosol-generating cartridge of FIG. 1C is illustrated schematically in FIG. 2. The method comprises depositing a plurality of deep-drawn metal containers or capsules 10 partially closed at one end and open at the other end into a vibratory feeding and orienting bowl 52, vibrating the bowl to cause the capsules to move from the bottom of the bowl to the rim, removing the capsules from the bowl at the rim, delivering the capsules by sliding down tracks 66 to a sorting and orienting device 54, orienting them so as to dispose the partially-closed end of each in the same direction, gravitationally depositing the oriented capsules in a holder 56 open-end up, moving the holder to a position to present the open ends of the capsules below a hopper 58 containing particulate material 20 carrying aerosol forming material, gravitationally depositing a predetermined quantity of particulate carrier material into the open ends of the capsules leaving an unfilled space at the upper ends of the capsules, moving the filled capsules to a position to receive the fuel elements 8 and pressing the fuel elements by rams 62 into the open ends of the capsules to a predetermined depth, leaving a predetermined length of the fuel element protruding from the open ends. A preferred device for sorting and filling capsules is manufactured by Robert Bosch Gmbh, Stuttgart, Germany, as Model No. MCF. This preferred device is described in copending U.S. Pat. application Ser. No. 063,207, filed June 17, 1987, now U.S. Pat. No. 4,782,644 which is hereby incorporated by reference.

Figure 1D:
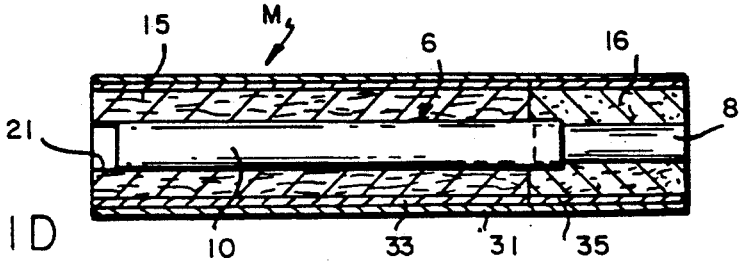

A preferred method of assembling the components of the aerosol generating module M of FIG. 1D includes the formation of a jacket segment A (FIG. 1B) having an insulating sleeve 16 and a resilient, preferably tobacco, rod 15, wrapping the sleeve 16 and rod 15 with a common wrapper 31, piercing the rod 15 to insert the aerosol generating cartridge B (FIG. 1C) therein, so that the fuel element 8 is circumscribed by the sleeve 16 and the capsule 10 is circumscribed by pierced tobacco rod 15 (FIG. ID).

The insulating sleeve 16, FIG. 1, is preferably a resilient layer of non-combustible fibers and has an inside diameter such as to receive the fuel element 8 and is wrapped with a wrapper 35.

A preferred insulating sleeve 16 is made by forming a ribbon or ribbons 16 of insulative fibers about a support member, such as a length of plastic tube 17, FIG. 3, of an outside diameter corresponding to the desired inside diameter of the sleeve 16 (e.g., diameter of fuel element 8) and then wrapping the insulating sleeve 16 with a paper wrapper 35. This is preferably accomplished by concomitantly advancing plastic tubing 17 and two ribbons 16 of insulating fibers through a conical folding element 48 to wrap the ribbons 16 about the plastic tube 43 and to bring the longitudinal edges of the ribbons into substantially abutting engagement, FIG. 3A, advancing the fiber-wrapped tubing together with a paper wrapper 35 through a cylindrical folding element 42 to wrap the wrapper paper 35 about the fiber-wrapped tubing 17 to bring its longitudinal edges into overlapping engagement, FIG. 3B, and adhesively uniting the overlapping edges. The wrapped tubing is cut into lengths 44 which are multiples of the desired length of the annular sleeve 16 for one smoking article. This step of forming insulating sleeves can be performed using a conventional machine obtained from Hauni-Werke, Model No. KDF-2, which is modified by inserting the conical shaped element 48 as illustrated in FIG. 3. A more detailed description of the conical shaped element and apparatus for forming the sleeves around a temporary support member can be found in copending application Serial No. 07/097,240, filed Sept. 15, 1987 (Attorney's Docket No. 37,350), which is hereby incorporated by reference.

The annular sleeve component for use in making smoking articles, i.e. comprising insulating fibers 16 annularly wrapped about a temporary support member such as tube 17, can be any length depending upon the particular design of the smoking articles. Typically, an annular sleeve component size for one smoking article is about 5 mm to about 30 mm long and has a circumference of about 17 mm to about 25 mm. However, these dimensions can be changed significantly for particular designs of smoking articles. For the preferred embodiment illustrated in FIG. 1, the sleeve component (in FIG. 1C) is about 10 mm long and has a circumference of about 24 mm.

The tobacco jacket 15, as illustrated in FIG. ID, circumscribes the capsule 10 and has an outside diameter the same as the sleeve 16 of insulating fibers and an inside diameter corresponding to the outside diameter of the capsule 10. The tobacco jacket 15 is wrapped with a wrapper paper 33. The tobacco jacket is formed by making a wrapped rod of tobacco 15 using conventional cigarette making equipment and cutting the tobacco rod into desired lengths.

In accord with the present invention, a preferred jacket segment A (FIG. 1B) comprising a predetermined length or section of sleeve of insulating material 16 formed about a removable sleeve forming a support member, such as a section of tube 17, and a predetermined length or section of tobacco rod 15 is made by abutting the sleeve and rod in axial alignment and wrapping them together with a common paper wrapping 31.

The aerosol generating module M (FIG. ID) is then formed by holding the jacket segment A (FIG. 1B), piercing the rod of tobacco 15 by effecting relative movement of the holder and a passage forming member to form a longitudinal or axial hole 21 at least partially through the rod of tobacco in alignment with the hole in the sleeve 16 of insulating material. Preferably, a spindle of a diameter slightly larger than the outside diameter of the aerosol generating cartridge B is used to radially displace the tobacco or other material forming the rod to form a passage to receive the aerosol generating cartridge.

The aerosol generating cartridge B (FIG. 1C) is then inserted into the jacket segment A so that the fuel element 8 is preferably positioned within the sleeve 16 of insulating fibers and the capsule 10 containing aerosol forming material is preferably positioned at least partially within the tobacco jacket 15. This is preferably accomplished by withdrawing the spindle used to make the hole in the tobacco rod 15 and simultaneously pushing the tube 17, upon which the sleeve 16 of insulating material is formed, through the hole 21 with the capsule end of the aerosol generating cartridge B. Thus, the tube 17 is ejected from the jacket segment as the cartridge B is inserted.

Although the jacket segment illustrated in FIG. 1 comprises a preformed sleeve portion and a rod of fibrous material portion, jacket segments for smoking articles that may be combined by the method of the present invention may also comprise (1) only a sleeve portion preformed about a support member, (2) a sleeve without a support member, (3) only a rod, or (4) other variations having portions that comprise a sleeve, which may be preformed, a rod, or combinations thereof. In such cases, the method of the present invention can be modified in accord with the teachings herein. For instance, if the jacket segment comprises only a rod portion, a piercing or passage forming step would normally be used to form a passage suitable for inserting the cartridge therein. Alternatively, the cartridge itself may be suitably shaped to be inserted into the rod without prior forming of a passage. If the jacket segment comprises only a sleeve portion, the method would be modified accordingly, for instance, to eliminate the piercing step and to simply eject any support member, preferably as the aerosol generating cartridge is inserted into the jacket segment.

In an alternative embodiment, the aerosol generating module is made by wrapping in axial alignment a plurality of rods of tobacco together with a plurality of annular segments or sleeves comprised of insulating material disposed about plastic tubes, with an annular segment between successive rods of tobacco, dividing the composite structure into modules embodying a length of tobacco rod having at each end thereof a length of sleeve of insulating material, dividing the modules, preferably midway between the ends of the tobacco rods, into sub-segments comprising a length of tobacco rod, at one end of which there is a length of sleeve of insulating material, piercing the length of tobacco longitudinally thereof to form a passage therethrough, and introducing an aerosol generating cartridge into the pierced length of tobacco and into the sleeve of insulating material and expelling the plastic tube.

The spacer member 24 of the mouthend piece module 22, FIG. 1, is preferably comprised of folded tobacco-containing sheet, but may comprise other suitable material such as, for example, a cellulose acetate tube, and has an outside diameter corresponding to the outside diameter of the tobacco rod and is wrapped, if required, with paper 36.

The mouthend element 26, FIG. 1, is of a diameter corresponding to the outside diameter of spacer member 24 and is comprised of suitable material such as, for example, non-woven polyproylene scrim or cellulose acetate fibers, and is wrapped with a wrapper 30. Optionally, the mouthend element 26 may be comprised of tobacco fibers, or charcoal, or any known material used for filtering or for cooling the smoke of a cigarette or other smoking article.

The mouthend piece 22 is formed of a predetermined length of spacer member and a predetermined length of the mouthend element. The mouthend element and preferred spacer member may be made by conventional means used to make filter elements for cigarettes. The presently preferred folded tobacco sheet spacer member and folded non-woven polypropylene scrim mouthend element can be made by double cone system comprising a cone within a cone, as is more fully described in copending U.S. application Ser. No. 07/089,692, filed Aug. 25, 1987 (Attorney's Docket No. 36,424) which is hereby incorporated by reference. The lengths of spacer member and mouthend element are abutted in axial alignment and wrapped in a common paper wrapping 32.

The mouthend pieces are conveniently made in quantity using modified conventional cigarette making equipment. Conveniently, they are made into a mouthend subassembly module, consisting of a double length of mouthend element at each end of which is a length of spacer member, or a double length of spacer member at each end of which is a length of mouthend element, for further use in making smoking articles in accord with a preferred embodiment of this invention. Typically, the mouthend pieces are 35 to 50 mm long, thus the subassemblies are 70 to 100 mm long. Other lengths can be used for particular designs of smoking articles.

The components thus described are assembled to form smoking articles according to a preferred method of this invention as follows.

Referring to FIGS. 4A and 4B there are diagrammatically illustrated the steps embodied in making the aerosol generating module M and mouthend piece 22. The steps involved in assembling the aerosol generating module M are shown in FIG. 4A. A sleeve 65 of insulating fibers formed about the plastic tube 67 and a preformed rod of tobacco 69 of solid cross section, each wrapped with a paper wrapper, not shown, are provided as described above. The tobacco rod 69 and sleeve 65 are divided into sections 72 and 70, respectively, each having a predetermined length. The sections 70 and 72 are disposed in axial alignment with the sections 70 disposed between the sections 72 (Step (3) in FIG. 4A) and the aligned structure is wrapped with a paper wrapper, not shown. The wrapped composite sections 70 and 72 are divided into jacket modules 76, each comprising a center tobacco section 78 and end sections 80 consisting of annular members or sleeves of insulating material (step (4) in FIG. 4A). The center section 78 is now divided midway between its ends to form two jacket segments 82, each for receiving the aerosol generating cartridge, each segment comprising a sleeve 85 of insulating fibers disposed about a corresponding length of tube 87 and a solid rod 89 of tobacco wrapped in a paper wrap, not shown.

The segments 82 are now appropriately supported by a support 84, step (5) in FIG. 4A, for alignment with a rotating spindle 86 provided with a tapered forward end 88. The support 84 is moved toward the spindle 86 to cause the spindle to enter the segment 82 through the tobacco 89 to form a hole in the rod of tobacco making an axial passage 90 lengthwise thereof and to partially enter into the tube 87 (step (6) in FIG. 4A), whereupon the support is moved in the opposite direction to withdraw the segment 82 from the spindle and impale it upon the aerosol generating cartridge comprising the aerosol generating capsule 10 and the fuel element 8 supported in alignment with the spindle thereby expelling the tube 87 through the hole 90 formed in the tobacco rod, (step (7) in FIG. 4A).

A preferred apparatus for mechanical insertion of the aerosol generating cartridge B into the jacket segment A (FIG. 1e1) comprising the sleeve 16 of insulating material and the tobacco rod 15 is illustrated in FIGS. 5, 6A to 6H, and 7-A to 7-0, which diagrammatically depict a rotating drum assembly apparatus (such as Model No. FR, manufactured by Hauni Werke, Korber & Co. AG., West Germany) and the operation of its various stations. This apparatus is described in copending application, U.S. Ser. No. 074,811, filed July 17, 1987, the disclosure of which is hereby incorporated by reference.

As shown in FIG. 5, preferably there are transfer drums D1, D2 and D3 disposed about the assembly drum 27 for rotation in timed relation to drum 27 for depositing the components "A" and "B" in the recesses 70 and 72 on each station, in timed relation with the movement of carriages and clamps, and for removing the aerosol generating modules M from the drum after assembly. Transfer drum D1 is preferably located on the upgoing side of drum 27 for depositing jacket segments "A" into recesses 70. Transfer drum D2 is preferably located near the top of drum 27 for depositing cartridges "B" into recesses 72. Transfer drum D3 is preferably located on the downgoing side of the drum 27 for removing the combined aerosol generating modules "M". The transfer drums are provided with recesses 106 for receiving the components and vacuum means depicted by the arrows for holding them in place on the transfer drums before or after transfer.

FIGS. 6-A–6-H and 7-A through 7-0 schematically depict the sequence of operation of the various stations on assembly drum 27. FIGS. 6-A to 6-H diagrammatically show the interaction of carriages 60.1 with cam surfaces 24.1 and 26.1 and the relative movements of the carriages 60.1, the clamps 66.1 and the abutment members 68.1. FIGS. 7-A through 7-0 diagrammatically show the movements of clamps 66.1, carriages 60.1 and abutment members 68.1 for the preferred Model FR which makes three aerosol generating modules at each station. These figures are presented solely for the purpose of illustrating relative movements and relative positions of the various parts of the carriages as shown.

FIGS. 6-A and 7-A show the clamp 66.1 displaced away from the spindles, for loading jacket segments "A". At this position, the recesses 70.1 on the carriage 60.1 are exposed. Jacket segments "A", preferably comprising a rod of tobacco, the sleeve of insulating fibers and the support tube, are now deposited in the recesses 70.1, as shown in FIGS. 6-B and 7-B, in alignment with the axis of the spindles 44.1. The claim 66.1 is now moved by the arm 78.1, by movement of coupling member 64.1 in conjunction with cam follower 62.1 following cam groove 24.1, as shown in FIG. 6-C, to a position to enclose the jacket segments "A" in recesses 70.1. See FIGS. 7-C and D.

Following movement of the clamp relative to enclosing segments "A", the carriage 60.1 is moved toward the spindles, by means of coupling member 64.1 and cam follower 62.1 in conjunction with cam groove 24.1. Carriage 60.1 carries with it jacket segments "A", enclosed by the clamp 66.1, to a position to impale the jacket segments on the rotating spindles 44.1, as shown in FIGS. 6-D, 7-E and 7-F. At this position (FIGS. 6-D and 7-F), the recesses 72.1 are exposed between the clamp 66.1 and the abutment members 68.1. The cartridges "B", comprising the capsule and fuel element, are now deposited between the clamp 66.1 and the abutment members 68.1 (FIG. 6-E and 7-G) with the fuel elements facing abutment members 68.1. The abutment members are then released by retraction of the latch 90.1 through the action of cam follower 100.1. Thus, the spring biased abutment members move into engagement with the cartridges "B" and press the latter into engagement with jacket segments "A" (FIG. 6-F and 7-H). Now the carriage 60.1 and clamp 66.1 are moved away from the spindles, which withdraws the jacket segments "A" from the spindles, expels the tubes 17 after passing through the openings in the tobacco rods, and impales the jacket segments "A" on the cartridges "B" (FIG. 6-G, 7-I to J). Finally, the carriage 60.1, clamp 66.1 and abutment members 68.1 are moved to their initial positions, as shown in FIGS. 6-H and 7-K to O, to free the composite structures "M" for pickoff, and to reengage latch 90.1.

Thus, in sequence, the aforesaid Model FR operates to pierce a rod of tobacco, one end of which has been attached to a sleeve of insulating fibers disposed about a plastic tube, to form a longitudinal passage through the rod of tobacco corresponding to the inside diameter of the sleeve, and thereafter insert an aerosol generating cartridge into the formed passage and the sleeve. The mouthend piece 22 comprising the spacer member 24 (depicted as a tube for illustrative purposes only) and the mouthend element 26 is formed by providing a tubular length 90, FIG. 4B, of cellulose acetate or a length of gathered tobacco sheet overwrapped with a paper wrapper to form a cylindrical element, and a length 94 of mouthend element wrapped with paper (not shown), dividing the tubular or cylindrical spacer member length 90 into sections 96 of equal length and the mouthend element length 94 into sections 100 of equal length, axially aligning alternating sections 96 with sections 100 (step (3) in FIG. 4B), wrapping them with a paper wrapper, not shown, and thereafter cutting the composite structure into the appropriate segments for further use. The lengths of sections 96 and 100 can vary widely depending upon the materials used and the particular smoking article being made. In the method illustrated in FIG. 4B, the composite structure is cut in the tubing or spacer member section 96 midway between the ends thereof to form mouthend modules or assemblies 104, each comprising a filter element 100 of twice the desired length of the filter element 26, at the opposite ends of which are tubular elements 108 corresponding to the desired length to the tubes 24. Alternatively, it may be desirable to cut the composite structure in the filter element section. Because the spacer member may be of varying size, depending upon the type of spacer member used, e.g. tube or folded tobacco-containing paper member, and upon the desired results, the illustrated figures in FIG. 4A and 4B are not to scale, nor are they intended to provide every detail of a smoking article or its components, but are provided merely to illustrate a preferred sequence of steps for making smoking articles.

To make smoking articles in accord with a preferred embodiment of this invention, an assembly 104 is now disposed between two of the aerosol generating modules 82 after inserting the aerosol generating cartridge (steps (8) and (9) in FIG. 4A), with the ends of the capsules 10 surrounded by tobacco abutting the open ends of the tubes 24, whereupon the assembly is wrapped and the filter section 104 is severed midway between the ends thereof (FIG. 4A, last view) to form two complete smoking articles 110, each comprising an aerosol generating module M and a mouthend piece 22.

It should be understood that the present disclosure is for the purpose of illustration only and the invention includes all modifications or improvements which fall within the scope of the appended claims. Available cigarette production machinery can be used by those of ordinary skill in the art to perform certain steps in the above-described method with little or no modification. The invention is not limited by the particular materials which are disclosed only for purposes of illustration. For example, other materials can be used to surround the aerosol generating capsule in place of tobacco. Materials other than fibrous materials may be used to form the sleeve or jacket segments. Other configurations of the aerosol generating cartridge may be employed. Other configurations of the mouthend piece may be used and they may comprise various other materials for filtering and or cooling the aerosol generated upstream.

What is claimed is:

1. A method for making a smoking article, the method comprising:

providing an aerosol generating cartridge comprising a fuel element and an aerosol forming material physically separate from the fuel element;

providing a sleeve for receiving the aerosol generating cartridge; and inserting the aerosol generating cartridge into the sleeve.

2. The method of claim 1 wherein the aerosol generating cartridge comprises a container for holding the aerosol forming material and the fuel element inserted into one end of the container.

3. The method of claim 1 wherein the sleeve comprises insulating material wrapped with paper.

4. The method of claim 1 wherein the sleeve comprises tobacco.

5. The method of claim 1 wherein the sleeve comprises at least two sections, each section having a different material.

6. The method of claim 1 wherein the sleeve includes a section comprising a non-tobacco insulating material and a section comprising tobacco material.

7. The method of claim 6 wherein the step of providing the sleeve includes abutting a tobacco material section and a non-tobacco insulating annular section in axial alignment, and wrapping the aligned sections with paper.

8. The method of claim 7 wherein the tobacco material section is in the form of a rod.

9. The method of claim 8, wherein the tobacco rod has an axial hole.

10. The method of claim 1, 3, 6 or 7 wherein the sleeve comprises an annular segment of fibrous insulating material.

11. A method for making a smoking article, the method comprising:

providing an aerosol generating cartridge comprising a fuel element and an aerosol forming material physically separate from the fuel element;

forming a sleeve comprising insulating material; and inserting the aerosol generating cartridge into the sleeve.

12. The method of claim 11 wherein the step of forming the sleeve comprises forming a rod of material and making a hole through at least a portion of the length of the rod.

13. The method claim 11 wherein the step of forming the sleeve comprises providing a rod of tobacco and making a hole at least a portion of the length of the tobacco rod.

14. The method of claim 11, 12 or 13 wherein the step of forming the sleeve comprises forming an annulus of fibrous material around a sleeve forming member, and wrapping the annulus of fibrous material with paper.

15. The method of claim 14 wherein the sleeve forming member is a tube.

16. The method of claim 1 or 11 further comprising the steps of:

forming a rod of tobacco;

combining the tobacco rod and sleeve comprising an annular section of insulating material in axial alignment, and wrapping the tobacco rod and annular section with paper; and making a hole axially in the tobacco rod with a hole forming member.

17. The method of claim 16, comprising forming an annular section by forming a non-tobacco insulating material around a passage forming member.

18. The method of claim 17, further comprising removing the passage forming member after the hole is formed in the tobacco rod.

19. The method of claim 17, further comprising ejecting the passage forming member through the hole in the tobacco rod to remove it from the annular section of insulating material.

20. The method of claim 17, wherein the step of inserting the aerosol generating cartridge comprises inserting the cartridge into the annular section thereby ejecting the passage forming member from the annular section.

21. The method of claim 17, further comprising ejecting the passage forming member from the annular section while simultaneously withdrawing the hole forming member and inserting the aerosol generating cartridge into the annular section.

22. A method according to claim 1 or 11 comprising forming a sleeve of material of a length substantially corresponding to the length of the aerosol generating cartridge.

23. The method of claim 1 or 11 wherein a portion of the sleeve is comprised of insulating fibers and another portion is comprised of tobacco, and the method further comprises inserting the aerosol generating cartridge into the sleeve to a position such that at least a portion of the aerosol forming material is circumscribed by the tobacco portion of the sleeve and at least a portion of the fuel element is circumscribed by the insulating fibers portion of the sleeve.

24. The method of claim 1 or 11 comprising forming a rod of fibrous material, joining the sleeve comprising an annular section of fibrous material to one end thereof, piercing the rod to provide a longitudinal passage at least partially therethrough to receive the aerosol generating cartridge, and inserting the aerosol generating cartridge into the passage to dispose at least a portion of the aerosol forming material within the longitudinal passage in the rod and at least a portion of the fuel element within the fibrous annular section.

25. The method of claim 1 or 11 comprising forming a rod containing tobacco, joining the sleeve comprising an annular section containing fibrous insulating material to one end thereof, piercing the rod to provide a longitudinal passage therein to permit insertion of the aerosol generating cartridge, and inserting the cartridge into the passage to dispose the aerosol forming material within the longitudinal passage in the rod and the fuel element within the annular section.

26. The method of claim 11 comprising forming the sleeve of insulating fibrous material about a tube, forming a rod of particulate material, joining one end of the rod to one end of the sleeve, piercing the rod to displace the particulate material to form a passage therein of a diameter corresponding to the outside diameter of the tube and inserting the aerosol generating cartridge into the passage while displacing the tube from the sleeve of fibrous material.

27. The method of claim 11 comprising forming insulative fibers into a sleeve about a tube, forming a rod of fibrous material, joining one end of said rod to one end of the sleeve of insulative fibers, piercing said rod to displace the fibers radially to form a passage therethrough of a diameter corresponding to the outside diameter of the tube and ejecting the tube from the sleeve of insulative fibers through the passage in the rod by inserting the aerosol generating cartridge into the sleeve, thereby pushing the tube from the sleeve and through the passage and continuing to insert the cartridge until the fuel element is disposed within the sleeve and the aerosol generating means is disposed within the passage.

28. The method of claim 26 or 27 comprising forming the rod of tobacco material.

29. A method of making a component of a smoking article, the method comprising assembling in axial alignment an alternating series of rods of tobacco and annular members comprising a .sleeve of insulating material; wrapping the adjacent rods and annular members with a common wrapper to form an integrated structure; and cutting the integrated structure to provide segments comprising a section of tobacco rod and a section of annular member.

30. The method of claim 29 wherein the cutting step comprises cutting the integrated structure to form jacket modules, each comprising a length of tobacco rod, with an annular member section at each end.

31. A method according to claim 30 comprising cutting the jacket module to form a wrapped rod of tobacco with a section of annular member at one end.

32. A method according to claim 29 wherein the annular members of insulating material are formed around a removable tube.

33. A method for making an aerosol generating module for a smoking article, the method comprising:

providing a jacket module comprising a rod containing tobacco, having a sleeve of insulating material at each end;

cutting the jacket module to form two jacket segments comprising a tobacco containing rod joined to a sleeve of insulating material;

making a longitudinal hole in the tobacco containing rod in each segment;

providing aerosol generating cartridges each comprising a fuel element and an aerosol forming material; and inserting a cartridge into each jacket segment such that the fuel element is at least partially disposed within the insulating sleeve and the aerosol forming material is at least partially disposed within the tobacco rod.

34. The method of claim 33 wherein the step of providing the jacket module comprises:

assembling in axial alignment an alternating series of rods of tobacco and annular sleeves of insulating material;

wrapping adjacent rods and sleeves with a common wrapper to form an integrated structure; and cutting the integrated structure to form jacket modules.

35. The method of claim 33 wherein the sleeve of insulating material is formed around a sleeve forming member, and the method further comprising effecting movement of a passage forming member through the rod of tobacco and, thereafter, simultaneously withdrawing the passage forming member and displacing the sleeve forming member from the insulating material while inserting the cartridge.

36. The method of claim 33 wherein the step of making the hole comprises effecting movement of a passage forming member through at least a portion of the tobacco rod to make a hole lengthwise therein.

37. The method of claim 36 wherein an aerosol generating cartridge is inserted into each of the two jacket segments while withdrawing the passage forming member from the tobacco rod.

38. The method of claim 36, further comprising forming the sleeve of insulating material around a sleeve forming member; and ejecting the sleeve forming member after the hole is made in the tobacco rod.

39. A method of forming aerosol generating modules for smoking articles, the method comprising wrapping a plurality of rods containing tobacco together with a plurality of sleeves containing insulating material in axial alignment wherein a sleeve is interposed between the ends of successive rods to form a composite structure, dividing the composite structure into segments having a length of rod and at each end thereof a length of sleeve, dividing the segments to form sub-segments comprising a segmental length of rod, at one end of which there is a length of sleeve, piercing the segmental length of rod longitudinally to form a passage therethrough and inserting an aerosol generating cartridge into the passage in the segmental length of rod and into the sleeve.

40. The method of claim 39 wherein the aerosol generating cartridge comprises an aerosol forming material and a fuel element, and the inserting step comprises inserting the cartridge into the sleeve and the passage formed in the rod in a direction so that the fuel element is at least partially disposed in the sleeve, and the aerosol forming material is at least partially disposed in the passage.

41. A method for making smoking articles, the method comprising:

providing aerosol generating modules comprising an aerosol generating cartridge including aerosol forming material and a fuel element at one end circumscribed with insulating material;

providing mouthend subassemblies;

aligning a mouthend subassembly between two aerosol generating modules such that the fuel element ends are disposed away from the mouthend assembly;

joining one mouthend subassembly to two aerosol generating modules by wrapping them together in a common wrapper to form an integrated structure; and cutting the integrated structure in the mouthend subassembly portion thereof to form two smoking articles.

42. The method of claim 41 wherein the mouthend subassembly comprises an elongate structure having a middle section of one construction and end sections of a different construction.

43. The method of claim 32 wherein the middle section comprises the construction that forms the mouthend of the smoking article.

44. The method of claim 41, 42 or 43 wherein the aerosol generating cartridge contains the aerosol forming material physically separate from the fuel element.

45. A method for making a smoking article, the method comprising:

providing an aerosol generating module comprising an aerosol generating cartridge containing a fuel element at one end and a physically separate aerosol forming material, wherein the aerosol forming material is at least partially surrounded with tobacco material;

providing a mouthend piece;

aligning the mouthend piece and aerosol generating module such that the fuel element end is opposite the mouthend piece; and joining the mouthend piece and aerosol generating module together by wrapping them in a common wrapper.

46. The method of claim 45, wherein the mouthend piece comprises a plurality of sections.

47. The method of claim 45 wherein the mouthend piece comprises a mouthend section and a spacer member section, and the module and mouthend piece are aligned and joined such that the spacer member section is adjacent the aerosol generating module.

48. A method for making a smoking article, the method comprising:

arranging a plurality of tobacco rods and insulating sleeves in an alternating series and wrapping them in a common wrapper to form a continuous structure;

cutting the continuous structure to form jacket members having a tobacco rod section joined to an insulating sleeve section;

providing an aerosol generating cartridge;

forming a hole through at least a portion of the length of the tobacco rod section of the jacket member;

inserting the aerosol generating cartridge into the hole in the tobacco rod and into the insulating sleeve to form an aerosol generating module;

providing a mouthend subassembly;

joining the mouthend subassembly with two aerosol generating modules, such that the tobacco rod end is attached to the mouthend subassembly; and splitting the mouthend subassembly between its ends to form two smoking articles.

49. The method of claim 48 wherein the cutting step includes:

cutting the continuous structure at intervals in the sleeve segments to form tobacco rod/insulating sleeve segments, each comprising a length of tobacco rod having at each end a length of insulating sleeve; and cutting the tobacco rod/insulating sleeve segments to form jacket members having a tobacco rod section joined to an insulating sleeve section.

50. The method of claim 48 or 49 comprising moving a hole forming member into the tobacco rod and, then, withdrawing the hole forming member while simultaneously inserting the aerosol generating cartridge.

51. A method of making a smoking article, the method comprising assembling a plurality of spacer member components with a plurality of mouthend components in axial alignment wherein a mouthend component is disposed between spacer member components; subdividing the assemblies to provide mouthend modules comprising a mouthend segment, at each end of which is a spacer member segment; assembling a plurality of tobacco rods with sleeves of insulating fibers in axial alignment such that a sleeve is interposed between successive tobacco rods; dividing the sleeves of insulating fibers to form subassemblies comprising a length of tobacco rod, at each end of which there is a sleeve segment of insulating fibers; dividing the subassemblies in the tobacco rod portion; making holes axially through the tobacco rods; providing aerosol generating cartridges and inserting them into the holes in the tobacco rods with one end thereof extending into the sleeve of insulating fibers to form an aerosol generating module; assembling the aerosol generating modules at the ends of the spacer member segments of the mouthend modules such that a tobacco rod end of an aerosol generating module is abutting each spacer member segment of the mouthend modules; joining the same by wrapping in a common wrapper and dividing the mouthend segments of the mouthend modules to form smoking articles.

52. An article of manufacture useful for making smoking articles, the article of manufacture comprising an elongate structure comprising two or more repeating sections wherein each section comprises (A) an annular segment comprising a predetermined length of a sleeve of insulating material and (B) a rod segment comprising a predetermined length of a rod of fibrous material, the annular segment longitudinally abutting the rod segment, the annular segment and rod segment together adapted for receiving an aerosol generating cartridge comprising a fuel element and an aerosol forming material physically separate from the fuel element, wherein the fuel element is disposed within the annular segment and the aerosol forming material is disposed within the rod segment.

53. An article of manufacture useful for making smoking articles, the article of manufacture comprising an elongate jacket module comprising (A) a rod segment comprising a predetermined length of a rod of fibrous material and (B) having disposed longitudinally on each side of the rod segment, an annular segment comprising a predetermined length of a sleeve of insulating material, the annular segment longitudinally abutting the rod segment, the annular segment and rod segment together adapted for receiving an aerosol generating cartridge comprising a fuel element and an aerosol forming material physically separate from the fuel element, wherein the fuel element is disposed within the annular segment and the aerosol forming material is disposed within the rod segment.

54. The article of manufacture of claim 51 wherein one end of each annular segment is adjacent to an end of the rod segment.

55. An article of manufacture useful for making smoking articles, the article of manufacture comprising an elongate structure comprising (A) an annular segment comprising a predetermined length of a sleeve of insulating material, and (B) having disposed longitudinally on each side of the annular segment, a rod segment comprising a predetermined length of a rod of fibrous material, the annular segment longitudinally abutting the rod segment, the annular segment and rod segment together adapted for receiving an aerosol generating cartridge comprising a fuel element and an aerosol forming material physically separate from the fuel element, wherein the fuel element is disposed within the annular segment and the aerosol forming material is disposed within the rod segment.

56. The article of manufacture of claim 55 wherein one end of each rod segment is adjacent to an end of the annular segment.

57. The article of manufacture of claim 52, 53, 54, 55 or 56 wherein the segments are joined end to end by a longitudinal wrapper circumscribing the segments.

58. The article of manufacture of claim 52, 53, 54, 55 or 56 wherein the rod segment comprises tobacco material.

59. The article of manufacture of claim 52, 53, 54, 55 or 56 wherein the annular segment comprises a support member circumscribed by a layer of resilient insulating material.

60. The article of manufacture of claim 52, 53, 54, 55 or 56 wherein the rod segment comprises tobacco material and the annular segment comprises a support member circumscribed by a layer of resilient insulating material.

61. An article of manufacture comprising an elongate structure comprising a mouthend module having disposed longitudinally on each side of the mouthend module an aerosol generating module, wherein the aerosol generating module comprises an aerosol generating cartridge having a fuel element at one end and an aerosol forming material, the aerosol generating cartridge being at least partially circumscribed with a sleeve of insulating material.

62. The article of claim 61 wherein the mouthend module comprises an elongate structure having a mouthend segment containing a porous material and having disposed longitudinally on each side of the mouthend segment a spacer segment.

63. The article of claim 62 wherein the mouthend segment comprises folded meltblown fibers and the spacer segment comprises folded tobacco-containing paper.

64. The article of claim 61 wherein the aerosol generating module comprises an aerosol generating cartridge having a fuel element attached to one end of a capsule comprising an aerosol forming material, the cartridge being surrounded by a sleeve comprising resilient insulating material.

65. The article of claim 64 wherein the sleeve further comprises tobacco, reconstituted tobacco or tobacco-containing material.

66. The article of claim 65 wherein the sleeve is disposed around the aerosol generating cartridge so that insulating material circumscribes the fuel element and the tobacco, reconstituted tobacco or tobacco-containing material circumscribes the capsule.

67. The article of claim 66 wherein the mouthend module comprises an elongate structure having a mouthend segment containing a porous material and having disposed longitudinally on each side of the mouthend segment a space segment.

68. The article of claim 67 wherein the mouthend segment comprises folded meltblown fibers and the spacer segment comprises folded tobacco-containing paper.

69. The article of claim 61, 62, 63, 64, 65, 66, 67 or 68 wherein the modules are joined end to end by a longitudinal wrapper circumscribing the modules.

70. An article of manufacture useful for making smoking articles, the article of manufacture comprising an elongate structure comprising two or more repeating sections wherein each section comprises (A) a spacer segment comprising a predetermined length of spacer member and (B) a mouthend segment comprising a predetermined length of mouthend member comprising a porous material, wherein the spacer segment comprises tobacco, reconstituted tobacco or a tobacco-containing material.

71. An article of manufacture useful for making smoking articles, the article of manufacture comprising an elongate structure comprising two or more repeating sections wherein each section comprises (A) a spacer segment comprising a predetermined length of spacer member and (B) a mouthend segment comprising a predetermined length of mouthend member comprising a porous material, wherein the spacer segment comprises tobacco, reconstituted tobacco or a tobacco-containing material, wherein the spacer member comprises a length of cellulose acetate tubing.

72. An article of manufacture useful for making smoking articles, the article of manufacture having an elongate structure comprising a mouthend segment comprising a predetermined length of mouthend member comprising a porous material and having disposed longitudinally on each side of the mouthend segment, a spacer segment comprising a predetermined length of spacer member, wherein the spacer segment comprises tobacco, reconstituted tobacco or a tobacco-containing material.

73. An article of manufacture useful for making smoking articles, the article of manufacture having an elongate structure comprising a mouthend segment comprising a porous predetermined length of mouthend member comprising a porous material and having disposed longitudinally on each side of the mouthend segment, a spacer segment comprising a predetermined length of spacer member, wherein the spacer segment comprises tobacco, reconstituted tobacco or a tobacco-containing material, wherein the spacer member comprises a length of cellulose actuate tubing.

74. The article of manufacture of claim 72 or 73 wherein one end of each spacer segment is adjacent to an end of the mouthend segment.

75. The article of manufacture of claim 70, 71, 72, or 73, wherein the segment are joined end to end by a longitudinal wrapper circumscribing the segments.

76. The article of manufacture of claim 75 wherein the spacer segment comprises folded tobacco-containing paper.

77. The article of manufacture of claims 70, 71, 72, or 73, wherein the mouthend segment comprises a plug of fibrous material.

78. The article of manufacture of claim 77 wherein the plug comprises folded meltdown fibers.

79. The article of manufacture of claim 77 wherein the plug comprises gathered non-woven polypropylene scrim or cellulose acetate fibers.

* * * * *

UNITED STATES PATENT AND TRADEMARK OFFICE

CERTIFICATE OF CORRECTION

PATENT NO. : 5,052,413

DATED : October 1, 1991

INVENTOR(S) : Max N. Baker et al.

It is certified that error appears in the above—identified patent and that said Letters Patent is hereby corrected as shown below:

On the Cover Sheet under Abstract, line 8, "logitudinally" should be --longitudinally--.

In the specification:

Col. 1, line 11, after "now" insert --U.S.--.
Col. 1, line 12, after "now" insert --U.S.--.
Col. 8, line 23, "FIG. 1e1" should be --FIG. 1B--.

Col. 11, line 22, after "hole" insert --through--.

In the claims:

Col. 14, line 24, "32" should be --42--.
Col. 16, line 9, "51" should be --53--.
Col. 17, line 14, "space" should be --spacer--.
Col. 18, line 16, delete "porous".

Signed and Sealed this

Sixth Day of April, 1993

*Attest:*

*Attesting Officer*

STEPHEN G. KUNIN

*Acting Commissioner of Patents and Trademarks*